United States Patent [19]

Haake

[11] 4,007,691

[45] Feb. 15, 1977

[54] SMOKE MARKER

[75] Inventor: Frederick L. Haake, Oxnard, Calif.

[73] Assignee: The United States of America as represented by the Secretary of the Navy, Washington, D.C.

[22] Filed: Dec. 23, 1975

[21] Appl. No.: 643,713

[52] U.S. Cl. ..... 102/90; 102/37.6; 222/95

[51] Int. Cl.[2] ..... F42B 4/00

[58] Field of Search ..... 102/6, 34.4, 35.6, 37.6, 102/37.8, 39, 65, 66, 90; 89/1 B; 222/95, 386.5

[56] References Cited

UNITED STATES PATENTS

| | | | |
|---|---|---|---|
| 2,557,162 | 6/1951 | Wetzel et al. | 222/95 |
| 2,671,579 | 3/1954 | Knoblock | 222/95 |
| 2,923,930 | 2/1960 | Del Mar | 222/95 |
| 3,308,818 | 3/1967 | Rutkowski | 222/95 |
| 3,423,818 | 1/1969 | Ruekberg | 222/95 |
| 3,712,224 | 1/1973 | Hanzel | 102/37.6 |
| 3,811,381 | 5/1974 | Fichter, Jr. | 102/66 |

FOREIGN PATENTS OR APPLICATIONS

| | | | |
|---|---|---|---|
| 977,386 | 12/1964 | United Kingdom | 102/37.6 |

OTHER PUBLICATIONS

Materials in Design Engineering, Reinhold Pub. Corp., vol. 60, No. 5, Mid-Oct. 1964, pp. 230, 231.

*Primary Examiner*—Verlin R. Pendegrass
*Attorney, Agent, or Firm*—Richard S. Sciascia; Joseph M. St.Amand; Darrell E. Hollis

[57] ABSTRACT

A smoke marker for indicating the location of a target drone. An aluminum tube with one open end and one closed end contains a polyethylene bottle filled with titanium tetrachloride, a smoke chemical. The bottle is held in place within the tube by means of set screws adjacent the bottle's neck. A nylon washer containing an explosive primer and a metallic disc are disposed between the bottle and the closed end of the tube. The open end of the tube is potted closed with styrofoam potting. Upon ignition, the explosive primer forces the copper disc to collapse the bottom of the bottle. The neck of the bottle shears and the titanium tetrachloride is expelled from the aluminum tube and the bottle, creating a 25 to 30 foot cloud of smoke.

10 Claims, 2 Drawing Figures

SMOKE MARKER

BACKGROUND OF THE INVENTION

1. Field of the Invention

The present invention relates generally to smoke markers and more particularly to smoke markers utilizing titanium tetrachloride for producing a momentary smoke covering.

2. Description of the Prior Art

The smoke ammunition which is used in the majority of military forces concerns generation of momentary or continuous smoke. It usually takes more than one minute for generating the continuous smoke. During this time, a rather constant quantity of smoke is emitted per unit of time from the smoke producing object which is spread by the wind in the direction of the wind. This kind of smoke is in the first place suitable for undertakings requiring a comparatively long duration and a screened area of great width. The momentary smoke is characterized in that the quantity of smoke is generated practically momentary, i.e., within a space of about one second. The smoke develops substantially into a spherical cloud of smoke which, depending upon its inherent heat, prevailing air temperature, air humidity and wind velocity, etc., is spreading, rising and laterally moving. This kind of smoke is suitable for smoke undertakings requiring a rapid screening effect within a very limited area.

The momentary smoke producers may be solids or liquids. Of the first mentioned ones, yellow phosphorus is considered to be most effective, but it has disadvantages because of its strongly exothermal reactions. This involves not only a considerable danger of fire but also a rapid rising of the generated cloud of smoke uncovering the target (so called "pillar effect").

Liquid smoke producers for a momentary smoke covering include smoke acid ($HCLSO_3 + SO_3$), titanium tetrachloride, and stannic chloride. An advantage of these smoke producers is that they generate a very dense smoke.

SUMMARY OF THE INVENTION

The general purpose of the present invention is to provide a smoke marker. To attain this, the present invention provides an aluminum tube having an open end and a closed end. A polyethylene bottle containing titanium tetrachloride, a smoke chemical, is disposed within the tube and held in place by several set screws disposed adjacent the neck of the bottle. A metallic disc and a nylon washer containing an explosive primer are disposed between the bottle and the closed end of the aluminum tube. Upon igniting the primer, the copper disc forces the bottom of the bottle to collapse, placing a force on the smoke producing chemical. This force shears the neck of the bottle and the titanium tetrachloride is expelled from the aluminum tube and the bottle, creating a 25 to 30 foot cloud of smoke.

Accordingly, one object of the present invention is to provide a smoke marker.

Another object of the present invention is to maximize the size of the smoke cloud.

Another object of the present invention is to reduce cost.

A still further object of the present invention is to increase efficiency.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

DETAILED DESCRIPTION OF THE PREFERRED EMBODIMENT

Figure 1:
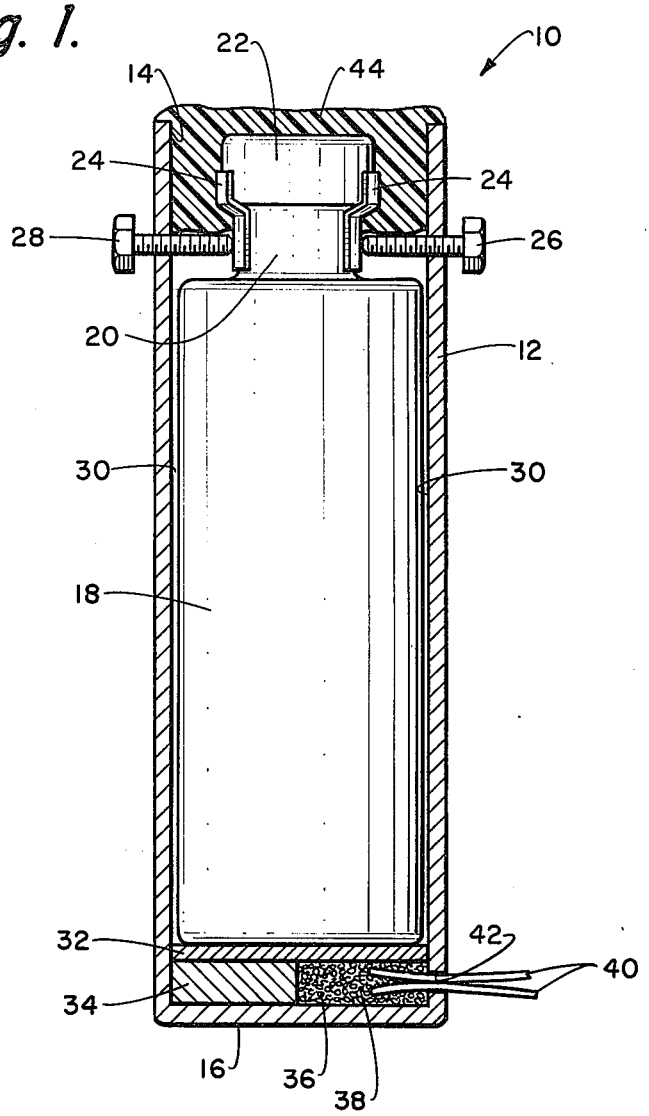
FIG. 1 is a cross-section of one embodiment of the present invention.

FIG. 1 illustrates a smoke marker 10 according to one embodiment of the present invention. Smoke marker 10 comprises an aluminum tube 12 having an open end 14 and a closed end 16. Metallic tube 12 is seamless and may be closed at closed end 16 by welding or other suitable means. Aluminum tube 12 may be manufactured of any other suitable material that is capable of withstanding an explosion of sufficient magnitude to eject the smoke chemical from tube 12. In the present invention, tube 12 is fabricated from aluminum for convenience purposes only.

A polyethylene bottle 18 is contained inside aluminum tube 12. Polyethylene bottle 18 has a neck portion 20 and a cap 22 fitting over neck portion 20. Polyethylene bottle 18 is filled with a smoke producing chemical such as titanium tetrachloride and is sealed with Teflon tape 24. Polyethylene bottle 18 is rigidly affixed inside aluminum tube 12 by means of set screws 26 and 28. As shown in FIG. 1, set screws 26 and 28 impinge upon polyethylene bottle 18 about neck section 20. Styrofoam potting 44 is utilized to close open end 14 of housing 12. It is noted that bottle 18 may be fabricated from any collapsible material with properties similar to polyethylene such as Teflon.

It is noted that the space between the sides of tube 12 and bottle 18, designated side space 30, is of such width that a snug fit is obtained between bottle 18 and aluminum tube 12.

Located between the bottom of polyethylene bottle 18 and the closed end 16 of aluminum tube 12 is a metallic disc 32 and a nylon washer 34. Nylon washer 34 contains a slot 36 in which explosive primer or squib 38 is disposed. A pair of wires 40 pass through a hole 42 in aluminum tube 12 terminating in explosive primer or squib 38. Wires 40 provide a means of igniting the explosive primer or squib 38. However, it is noted that other sufficient means may be utilized to ignite explosive primer or squib 38. It is noted that the hole 42 is potted closed.

When the squib or explosive primer 38 is ignited, metal disc 32 is driven into the bottom of the titanium tetrachloride filled bottle 18. Bottle 18 cannot be ejected from metal tube 12 because of the set screws 26 and 28. Thus, the copper disc 32 collapses the bottom of bottle 18, placing a force on the titanium tetrachloride liquid. This force on the liquid causes the neck 20 of bottle 18 to shear off. This results in the liquid coming out of tube 12 at such a force that it ejects approximately 25 feet and forms a visual white cloud approximately 25 to 30 feet in diameter. Polyethylene bottle 18 remains inside tube 12 after the smoke chemical is ejected.

Figure 2:
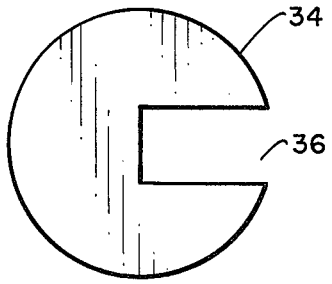
FIG. 2 is a top view of a component illustrated in FIG. 1.

FIG. 2 illustrates a top view of the washer 34 of FIG. 1 illustrating slot 36.

While it is envisioned that the smoke marker 10 of the present invention will be utilized on target drones, it is also envisioned that smoke marker 10 may be utilized for any of a plethora of functions in which a smoke marker is needed. It is noted that titanium tetrachloride is the smoke chemical disclosed herein. However, it is envisioned that other suitable and sufficient smoke producing chemicals may be utilized in place of titanium tetrachloride.

Obviously numerous modifications and variations of the present invention are possible in light of the above teachings. It is therefore to be understood that within the scope of the appended claims the invention may be practiced otherwise than as specifically described herein.

What is claimed is:

1. A smoke marker comprising:

a. a seamless tubular housing having one closed end and one open end, said housing being fabricated from an explosive-proof material;

b. a closed, collapsible, tubular container having a neck portion, said tubular container being disposed in said tubular housing, said container being filled with a column of smoke generating chemical;

c. means abutting said neck portion of said tubular container for rigidly attaching said tubular container to said tubular housing and for shearing said neck portion of said tubular container from said tubular container when a sufficient force is applied to said column of smoke generating chemical;

d. means disposed between said tubular container and said closed end of said tubular housing for generating and applying said sufficient force to said column of smoke generating chemical such that said neck portion of said tubular container and said column of smoke generating chemical are ejected from said tubular container.

2. The apparatus of claim 1 wherein said tubular container includes a polyethylene bottle having a neck portion with a cap attaching thereto.

3. The apparatus of claim 2 wherein said attaching means includes a plurality of set screws disposed in abutting relationship to said bottle neck.

4. The apparatus of claim 1 wherein said forcing means includes:

a. a metallic member adjacent said tubular container;

b. means disposed between said metallic member and said closed end of said tubular housing for holding an explosive primer;

c. means communicating with said explosive primer for igniting said explosive primer forcing said metallic member to collapse said tubular container placing a force on said chemical, causing said tubular container to shear adjacent said open end of said tubular housing, whereby said smoke generating chemical is expelled through said open end of said tubular housing.

5. The apparatus of claim 4 wherein said metallic member includes a metallic disc.

6. The apparatus of claim 4 wherein said explosive primer holding means includes a nylon washer having a slot therein containing said explosive primer.

7. The apparatus of claim 4 wherein said igniting means includes a pair of wires extending from said explosive primer through said tubular housing.

8. The apparatus of claim 4 wherein said tubular container includes a bottle having a neck portion with a cap attaching thereto and a bottom portion.

9. The apparatus of claim 8 wherein said attaching means includes a plurality of set screws disposed in abutting relationship to said bottle neck, said igniting means exploding said explosive primer, forcing said metallic member to collapse the bottom of said bottle, transmitting a force to said chemical, said force shearing the neck of said bottle, whereby said smoke generating chemical is expelled from said tubular housing.

10. The apparatus of claim 1 further comprising potting material disposed in said open end of said tubular housing adjacent said neck portion of said tubular container for sealing said tubular housing.

* * * * *